US009315051B1

(12) United States Patent
Ozawa

(10) Patent No.: US 9,315,051 B1
(45) Date of Patent: Apr. 19, 2016

(54) PRINTING DEVICE, PRINTING DEVICE CONTROL METHOD, AND NON-TRANSITORY COMPUTER-READABLE NONVOLATILE RECORDING MEDIUM HAVING STORED THEREON PRINTING DEVICE CONTROL PROGRAM

(71) Applicant: CASIO COMPUTER CO., LTD., Tokyo (JP)

(72) Inventor: Takeo Ozawa, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/849,874

(22) Filed: Sep. 10, 2015

(30) Foreign Application Priority Data

Oct. 29, 2014 (JP) ..... 2014-219822
Mar. 23, 2015 (JP) ..... 2015-060050

(51) Int. Cl.
*B41J 11/00* (2006.01)
*B41J 13/00* (2006.01)

(52) U.S. Cl.
CPC ..... *B41J 13/0009* (2013.01)

(58) Field of Classification Search
USPC ..... 347/4, 5, 16, 104, 171, 197, 198, 218, 347/220, 221, 222; 400/578, 621, 621.1, 400/633; 83/162, 438
See application file for complete search history.

(56) References Cited

U.S. PATENT DOCUMENTS 6,152,561 A * 11/2000 Watanabe ..... B41J 13/103 347/104
7,374,281 B2 * 5/2008 Saito ..... B41J 3/4071 347/104
8,096,717 B2 * 1/2012 Kubota ..... B41J 3/4075 347/218
2009/0162125 A1 * 6/2009 Kubota ..... B41J 3/4075 400/611

FOREIGN PATENT DOCUMENTS

JP H7-266622 A 10/1995
JP H8-310034 A 11/1996
JP H9-290524 A 11/1997
JP 2000-246980 A 9/2000
JP 2001-130074 A 5/2001
JP 2011-230428 A 11/2011

* cited by examiner

*Primary Examiner* — Kristal Feggins
(74) *Attorney, Agent, or Firm* — Fitch Even Tabin & Flannery LLP

(57) ABSTRACT

A printing device, including: a print data creator creating print data to print on a medium; a head printing on the medium on a line basis based on the print data; a drive motor conveying the medium as the print data are printed on the medium; a printing control data creator creating printing control data controlling the head and drive motor, the printing control data including control data to pause printing on the medium by the head; and a backward rotation controller determining based on state of the print data or the printing control data whether to rotate the drive motor in the opposite direction to before the printing on the medium by the head is paused while the printing on the medium by the head is paused.

19 Claims, 13 Drawing Sheets

PRINTING DEVICE, PRINTING DEVICE CONTROL METHOD, AND NON-TRANSITORY COMPUTER-READABLE NONVOLATILE RECORDING MEDIUM HAVING STORED THEREON PRINTING DEVICE CONTROL PROGRAM

CROSS-REFERENCE TO RELATED APPLICATION

This application claims the benefit of Japanese Patent Application Nos. 2014-219822 and 2015-060050, filed on Oct. 29, 2014, and Mar. 23, 2015, respectively, the entire disclosure of which is incorporated by reference herein.

FIELD

This application relates generally to a printing device, printing device control method, and non-transitory computer-readable nonvolatile recording medium having stored thereon a printing device control program.

BACKGROUND

In the prior art, there are tape printers printing character strings on a tape-like recording sheet to create labels to attach to various items.

Such a tape printer comprises a cassette loader in which a cassette housing a tape as a medium on which print is made is loaded. In the cassette loader, a thermal head printing on the tape, a platen roller clamping and conveying the tape between the thermal head and itself, a cutter cutting the printed tape, and the like are provided.

In the meantime, tape printers sometimes pause printing in the middle of printing for conducting given tasks. This occurs, for example, when the tape should be cut for ensuring a margin set before the character strings to print, when the temperature of the thermal head becomes excessively high in the middle of printing and the thermal head should be cooled for proper printing control, or when the print data should be loaded in the process of printing.

For pausing the printing, the drive motors of the thermal head and platen roller are stopped with the platen roller held at the print position in order to prevent the tape shifting during the given task. Then, after the given task ends, the drive motors of the thermal head and platen roller are controlled to resume the printing.

In the meantime, tape printers comprising a platen roller movable relative to the thermal head and provided with the above-described platen roller drive means have the risk of advancing the tape while the printing is paused and causing omitted printing.

For addressing the above problem, in the prior art, techniques of rotating the drive motors backward by a certain fixed angle while the printing is paused to prevent omitted print are known (for example, the technique described in Patent Literature 1).

Furthermore, techniques of reprinting the print line immediately before the tape is stopped while the printing is paused to prevent omitted print are known (for example, the technique described in Patent Literature 2).

Patent Literature 1: Unexamined Japanese Patent Application Kokai Publication No. 2000-246980; and Patent Literature 2: Unexamined Japanese Patent Application Kokai Publication No. H7-266622.

SUMMARY

However, it was found that even with application of the above prior art techniques, depending on the pattern (state) of print data, the thermal head and ink ribbon are likely to adhere and there is the risk of causing omitted print. Furthermore, presumably, there are various factors for omitted print besides adhesion between the thermal head and ink ribbon. For example, the above Patent Literature 2 states that cutting the tape while the printing is paused is one of the factors. Furthermore, with regard to the above-mentioned adhesion, when the head temperature change during the pause is small, for example when the pause lasts for a relatively short time or some measures such as proper electrification to hold the head temperature constant while the printing is paused are taken, conversely, the thermal head and ink ribbon are presumably unlikely to adhere. As just mentioned, not only the print data pattern but also the states of various printing control data for controlling the printing such as the cutter control and the duration of pause of printing for conducting the above given tasks may cause omitted print.

The printing device according to the present disclosure comprises:

a print data creator creating print data to print on a medium;

a head printing on the medium on a line basis based on the print data;

a drive motor conveying the medium as the print data are printed on the medium;

a printing control data creator creating printing control data controlling the head and the drive motor, the printing control data including control data to pause printing on the medium by the head; and a backward rotation controller determining based on state of the print data or the printing control data whether to rotate the drive motor in the opposite direction to before the printing on the medium by the head is paused while the printing on the medium by the head is paused.

Furthermore, the printing device according to the present disclosure comprises:

a print data creator creating print data to print on a medium;

a head printing on the medium on a line basis based on the print data;

a drive motor conveying the medium as the print data are printed on the medium;

a printing control data creator creating printing control data controlling the head and the drive motor, the printing control data including control data to pause printing on the medium by the head; and a backward rotation controller determining based on state of the print data or the printing control data whether to rotate the drive motor in the opposite direction to before the printing on the medium by the head is paused by a first quantity while the printing on the medium by the head is paused, or rotate the drive motor in the opposite direction to before the printing on the medium by the head is paused by a second quantity smaller than the first quantity while the printing on the medium by the head is paused.

The printing device control method according to the present disclosure is a control method for a printing device comprising a print data creator creating print data to print on a medium; a head printing on the medium on a line basis based on the print data; a drive motor conveying the medium as the print data are printed on the medium; and a printing control data creator creating printing control data controlling the head and the drive motor, the printing control data including control data to pause printing on the medium by the head, wherein it is determined based on state of the print data or the printing control data whether to rotate the drive motor in the opposite direction to before the printing on the medium by the head is paused while the printing on the medium by the head is paused.

The non-transitory recording medium according to the present disclosure is a non-transitory computer-readable non-volatile recording medium having stored thereon an executable program, the program being a printing device control program for a computer to read and allow a controller of a printing device, the printing device comprising: a print data creator creating print data to print on a medium; a head printing on the medium on a line basis based on the print data; a drive motor conveying the medium as the print data are printed on the medium; and a printing control data creator creating printing control data controlling the head and the drive motor, the printing control data including control data to pause printing on the medium by the head, to determine based on state of the print data or the printing control data whether to rotate the drive motor in the opposite direction to before the printing on the medium by the head is paused while the printing on the medium by the head is paused.

BRIEF DESCRIPTION OF THE DRAWINGS

A more complete understanding of this application can be obtained when the following detailed description is considered in conjunction with the following drawings, in which.

DETAILED DESCRIPTION

Figure 1:
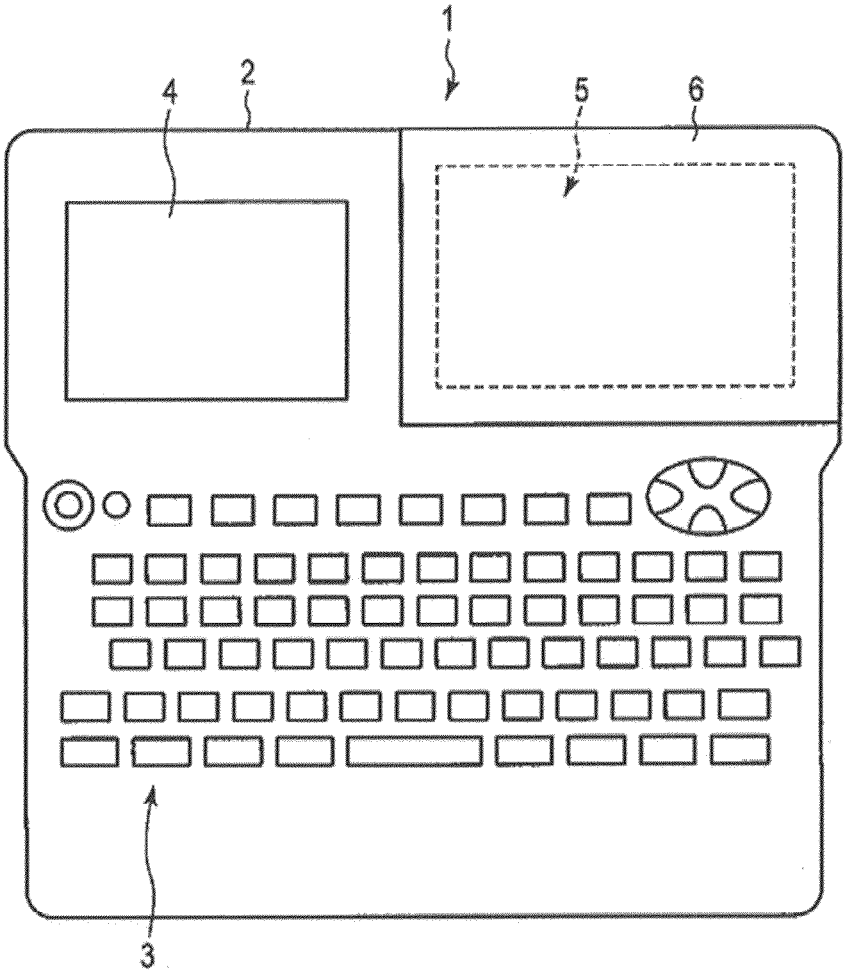
FIG. 1 is a plan view of the printing device showing an embodiment of the present disclosure.
Figure 2:
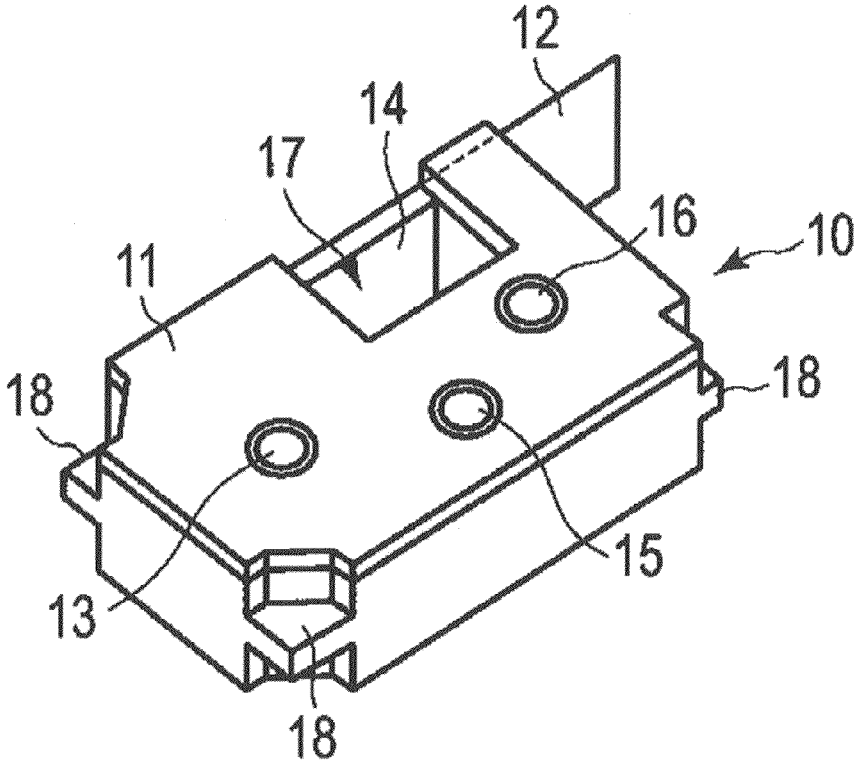
FIG. 2 is a perspective view of a tape cassette used with the printing device.
Figure 3:
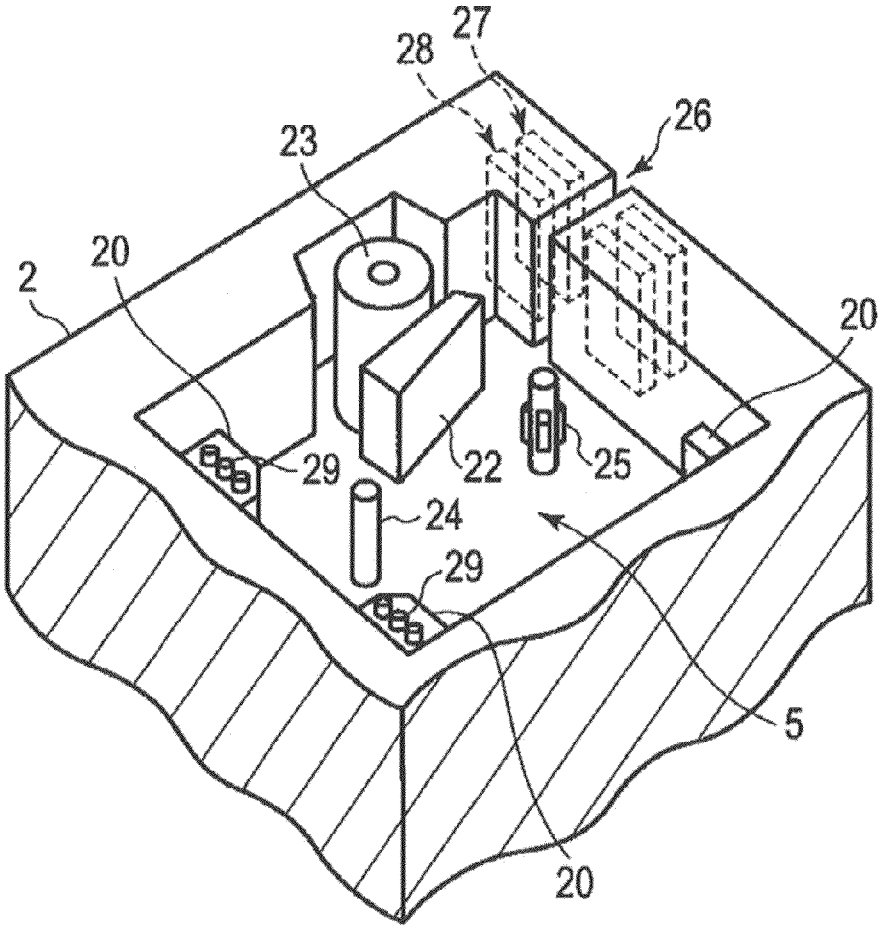
FIG. 3 is a perspective view of the tape cassette housing of the printing device.

The mode for implementing the present disclosure will be described in detail hereafter with reference to the drawings. FIG. 1 is a plan view of a printing device 1 showing an embodiment of the present disclosure, FIG. 2 is a perspective view of a tape cassette 10 used with the printing device 1, and FIG. 3 is a perspective view of a tape cassette housing 5 of the printing device 1.

The printing device 1 is intended for printing on a roll of medium having an adhesive layer on the back and can be used to create labels and the like carrying a name and other information printed on the medium.

The printing device 1 comprises, as shown in FIG. 1, a keyboard inputter 3 and display 4 provided on the top surface of an enclosure 2, and the tape cassette housing 5 provided within the enclosure 2. The tape cassette housing 5 is open to the top surface of the enclosure 2 and closed by an opening/closing lid 6. Furthermore, although not shown, the enclosure 2 is provided with a power cord connection terminal, an external device connection terminal, a storage medium insertion slot, and the like.

The keyboard inputter 3 comprises input keys for entering various data such as characters, a cursor key for moving the cursor of the display 4, various mode setting keys, an enter key for the set mode, and the like. The keyboard inputter 3 functions as input means.

The display 4 comprises, for example, a liquid crystal display panel. The display 4 displays operation procedure messages to the user of the printing device 1, various kinds of input information entered from the keyboard inputter 3, a selection menu for various settings, selected setting information, print images, and the like.

The printing device 1 uses as the medium for printing a printing tape having a printable surface on the front and an adhesive surface on the back on which a releasable tape is applied. This medium is termed a printing tape hereafter. The printing tape is placed in the tape cassette 10 shown in FIG. 2.

As shown in FIG. 2, the tape cassette 10 comprises, within a cassette casing 11, a tape core 13 around which a printing tape 12 is wound, an ink ribbon feed core 15 around which an ink ribbon 14 is wound, and an ink ribbon take-up core 16.

As shown in FIG. 2, the cassette casing 11 has a print head inserter 17 in the form of a recess in one side of the cassette casing 11. The ink ribbon 14 is dispensed from the ink ribbon feed core 15, guided by not-shown guide means provided within the cassette casing 11 to pass by the side of the cassette casing 11 within the print head inserter 17, and wounded around the ink ribbon take-up core 16.

Furthermore, the printing tape 12 is a paper tape, resin tape, magnet tape, or the like having on the side opposite to the printable surface an adhesive surface on which a releasable tape is applied. The printing tape 12 has an equal width to the ink ribbon 14. The printing tape 12 is dispensed from the tape core 13, guided by guide means to pass through the print head inserter 17 with the printable surface faced with the outer surface of the ink ribbon 14, and protruded from a not-shown tape exit provided to the cassette casing 11.

On the other hand, as shown in FIG. 3, in the tape cassette housing 5 of the enclosure 2, multiple cassette receivers 20 for supporting the tape cassette 10 at a given position are provided.

Furthermore, in the tape cassette housing 5, a print head 22, a platen roller 23, a tape core engaging shaft 24 engaging with the tape core 13 of the tape cassette 10, and an ink ribbon take-up drive shaft 25 engaging with the ink ribbon take-up core 16 of the tape cassette 10 are provided.

The cassette receivers 20 correspond to engagers 18 formed in multiple corners of the cassette casing 11. The tape cassette 10 is set in the tape cassette housing 5 at a given position with the portions of the printing tape 12 and ink ribbon 14 exposed in the print head inserter 17 being inserted between the print head 22 and platen roller 23, the tape core 13 and ink ribbon take-up core 16 being engaged with the tape core engaging shaft 24 and ink ribbon take-up drive shaft 25, respectively, and the engagers 18 being engaged with the cassette receivers 20.

In FIG. 3, the print head 22 is positioned to enter the print head inserter 17 of the tape cassette 10 and pressed against the ink ribbon 14 upon start of printing. Furthermore, the platen roller 23 is positioned to face the printing surface of the print head 22 and advances the ink ribbon 14 and printing tape 12 clamped between the print head 22 and itself in the longitudinal direction of the printing tape 12 intermittently at a certain pitch. The platen roller 23 is rotated by a stepping motor 38 shown in FIG. 4 described later intermittently at a certain pitch. The ink ribbon take-up drive shaft 25 is rotated by the stepping motor 38 in sync with the advancement of the tape by the platen roller 23. Here, the print head 22 and stepping motor 38 are controlled via a print head drive circuit 37 and motor drive circuit 39 shown in FIG. 4 described later, respectively, based on printing control data created by a controller 30 shown in FIG. 4 described later.

In this embodiment, the ink ribbon 14 is a thermal transfer ink ribbon and the print head 22 is a thermal head comprising a given number of dot heat-generating elements lined up in the vertical direction, namely in the width direction of the ink ribbon 14 and printing tape 12. With the heat-generating elements corresponding to the print data supplied to the print head 22 among the row of heat-generating elements being driven by the print head drive circuit 37 in time with stoppage of the ink ribbon 14 and printing tape 12 advanced intermittently, the print head 22 transfers ink of the ink ribbon 14 to the printing tape 12. As a result, the print head 22 operates as a head printing one line at a time on the printing tape 12 (medium) through driving of the print head drive circuit 37 based on print data created by the controller 30.

Furthermore, the tape cassette housing 5 comprises a tape discharger 26 for discharging the printed printing tape 12 dispensed from the tape cassette 10 outside the enclosure 2 as the printing progresses, and a full-cut mechanism 27 and half-cut mechanism 28 cutting off the printed portion of the printing tape 12, namely the created print piece (for example, a label) from the printing tape 12. The full-cut mechanism 27 and half-cut mechanism 28 are provided at the tape discharger 26 and one of them is selected and driven by a tape cut motor 40 shown in FIG. 4 described later. Here, the tape cut motor 40 is controlled individually via a cut motor drive circuit 41 based on printing control data created by the controller 30.

The full-cut mechanism 27 conducts a full-cut operation in which the printing tape 12 is cut along with the releasable tape. When the full-cut mechanism 27 is selected, the created print pieces are discharged as print pieces with the releasable tape. On the other hand, the half-cut mechanism 28 conducts a half-cut operation in which the printing tape 12 is cut with the releasable tape intact. When the half-cut mechanism 28 is selected, the print pieces are retrieved by removing them from the releasable tape that is still connected to the tape cassette 10 in the enclosure 2, or retrieved as print pieces with the releasable tape by activating the full-cut mechanism 27 at a proper time to cut the releasable tape.

On the other hand, the tape cassette 10 is of multiple kinds different in width of the printing tape 12 and ink ribbon 14. A tape cassette having a tape width suitable for the size of print pieces to create is set in the tape cassette housing 5.

Therefore, in this embodiment, the print head 22 having a print width (the length of the array of heat-generating elements) corresponding to the widest tape among various tape widths is used, and depending on the tape width of the tape cassette 10 set in the tape cassette housing 5, the heat-generating elements in the effective range corresponding to the width of the printing tape 12 among the row of heat-generating elements of the print head 22 are driven.

Furthermore, in this embodiment, irregular portions for identification (not shown) different depending on the kinds of the tape cassette 10 are formed on the surfaces of the engagers 18 of the cassette casing 11 that engage with the cassette receivers 20, and tape width detection switches 29 detecting the shape of the irregular portion of the engager 18 are provided at the cassette receivers 20 of the tape cassette housing 5 so as to be able to automatically determine the kind of the tape cassette 10, namely the tape width of the printing tape 12 and set the effective range of the print head 22.

Figure 4:
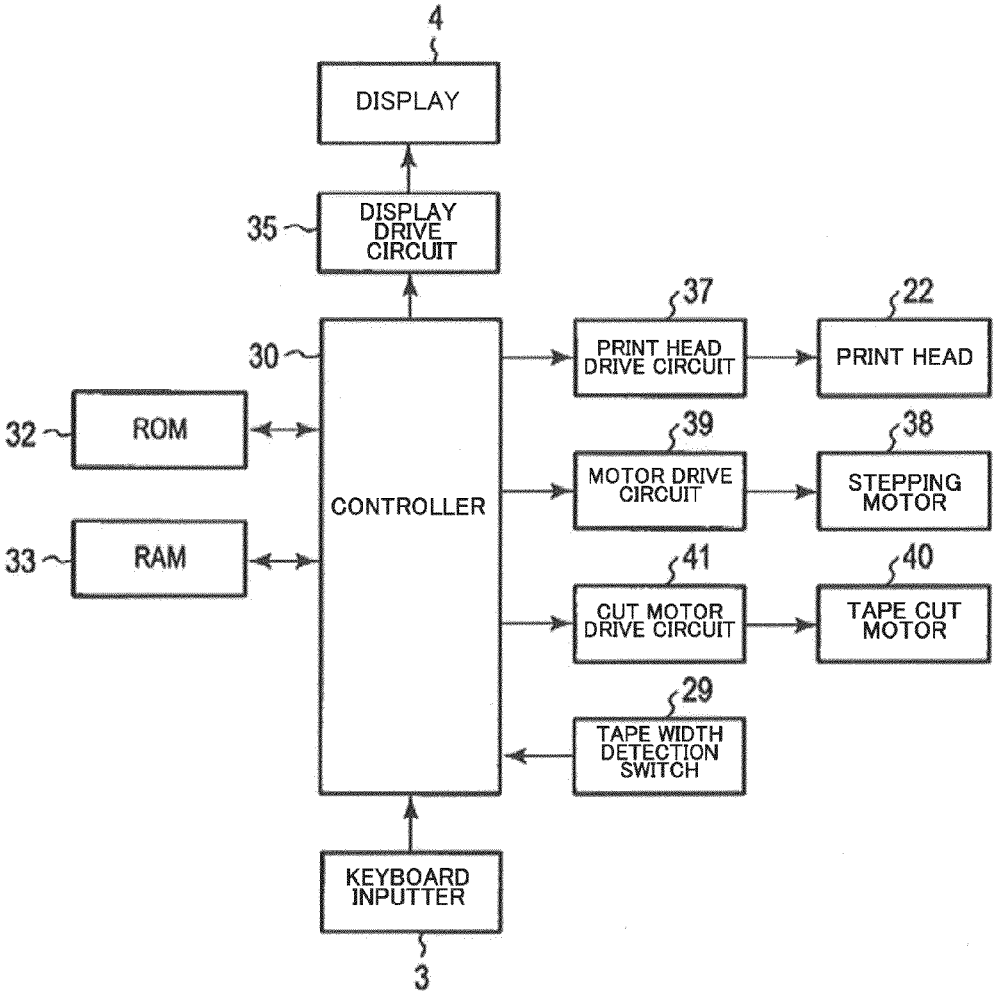
FIG. 4 is a block diagram of the printing device.

FIG. 4 is a block diagram of the printing device 1. This printing device 1 comprises the print head 22 (see FIG. 3), print head drive circuit 37 driving the print head 22, stepping motor 38, motor drive circuit 39 driving the stepping motor 38, tape cut motor 40, cut motor drive circuit 41 driving the tape cut motor 40, and tape width detection switches 29. Furthermore, the printing device 1 comprises the display 4 (see FIG. 1), a display drive circuit 35 driving the display 4, and the keyboard inputter 3 (see FIG. 1). Furthermore, the printing device 1 comprises the controller 30, a ROM 32, and a RAM 33.

The display drive circuit 35 displays on the display 4 information regarding input from the keyboard inputter 3, the selection menu for various settings, messages regarding various procedures, and the like according to instructions based on display control data created by the controller 30.

The stepping motor 38 rotates the platen roller 23 and ink ribbon take-up drive shaft 25 described above in the explanation of FIG. 3. The stepping motor 38 rotates in one direction along with printing of the print data on the printing tape 12 (medium) so as to operate as the drive motor conveying the printing tape 12 along a certain direction. Furthermore, as described later, the stepping motor 38 can rotate in the direction opposite to the one direction that is the rotation direction before the pause as needed while the printing of the print data on the printing tape 12 is paused. Furthermore, the stepping motor 38 is controlled via the motor drive circuit 39 according to instructions based on printing control data created by the controller 30.

The tape cut motor 40 is a common motor driving the full-cut mechanism 27 and half-cut mechanism 28 described above in the explanation of FIG. 3. The tape cut motor 40 can be engaged with one of the full-cut mechanism 27 and half-cut mechanism 28 and disengaged from the other and drive the selected cut mechanism between the full-cut mechanism 27 and half-cut mechanism 28. Furthermore, the tape cut motor 40 is controlled via the cut motor drive circuit 41 according to instructions based on printing control data created by the controller 30.

A system program, JIS codes-compliance pattern data of various characters and the like, input data processing programs, display programs, printing programs, and the like are preregistered in the ROM 32. Here, these programs may be read and stored from a storage medium such as a memory card inserted in a not-shown storage medium insertion slot of the printing device 1, or an external device such as a personal computer connected to the external device connection terminal.

The controller 30 is, for example, a microprocessor. The controller 30 activates the system program and the like stored in the ROM 32 according to key input by the user through the keyboard inputter 3, and using the RAM 33 as the work memory, receives key input by the user on the keyboard inputter 3 and tape width detection signals from the tape width detection switches 29. Then, the controller 30 operates as a print data creator creating print data to print on the printing tape 12 (medium). Furthermore, the controller 30 operates as a printing control data creator creating printing control data for controlling the print head 22, stepping motor 38, and tape cut motor 40 via the print head drive circuit 37, motor drive circuit 39, and cut motor drive circuit 41, respectively. Furthermore, the controller 30 operates as a display controller controlling the display 4 via the display drive circuit 35. Even furthermore, the controller 30 operates as a backward rotation controller for controlling the stepping motor 38 via the motor drive circuit 39.

The RAM 33 temporarily stores input data, display data, print data, and printing control data from the keyboard inputter 3 and a touch panel 7, and pattern data of characters and the like, display data, print data, and the like read from the ROM 32 by the controller 30.

The printing process of the printing device 1 will be described hereafter.

The printing device 1 sometimes pauses printing for conducting a given task in the middle of printing. That occurs, for example, as mentioned above in the explanation of FIG. 3, when the full-cut mechanism 27 cuts the printing tape 12 along with the releasable tape and when the half-cut mechanism 28 cuts only the printing tape 12 and leaves the releasable tape uncut. That also occurs when the temperature of the thermal head becomes excessively high in the middle of printing and the thermal head should be cooled for proper printing control or when the print data should be loaded in the process of printing. Here, the given task is not limited to the above cases and may be some other tasks as long as it is necessary to pause the printing in order to conduct those tasks. For pausing the printing, in FIG. 4, the controller 30 stops the drive of the print head 22 by the print head drive circuit 37 and the rotation of the platen roller 23 by the stepping motor 38 with the platen roller 23 (see FIG. 3) held at the print position for preventing the printing tape 12 shifting during the given task. Then, after the given task ends, the controller 30 controls the print head drive circuit 37 and motor drive circuit 39 to resume the printing.

Figure 5A:
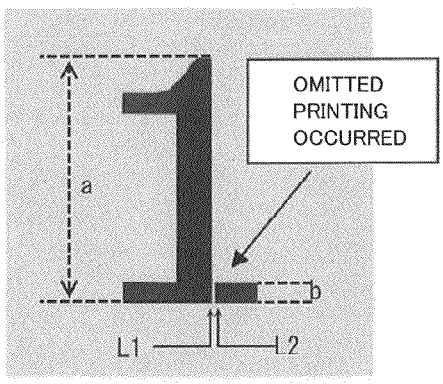
FIGS. 5A and 5B are illustrations for explaining an embodiment.
Figure 5B:
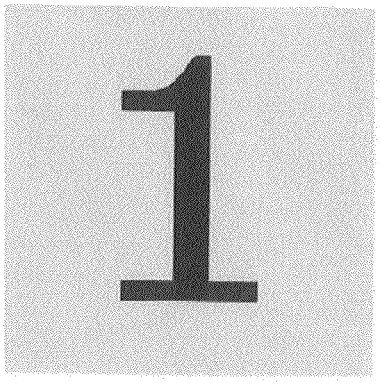

Here, when the printing is paused, omitted printing may occur, for example, as shown in FIG. 5A. Then, in the embodiments described below, the printing tape 12 is rotated backward based on the print data while the printing is paused so as to realize printing without omitted printing, for example, as shown in FIG. 5B. Here, one of the factors causing omitted printing is the above-mentioned advancement of the printing tape 12 while the printing is paused. However, presumably, there are various other factors interacting to cause omitted printing.

Figure 6:
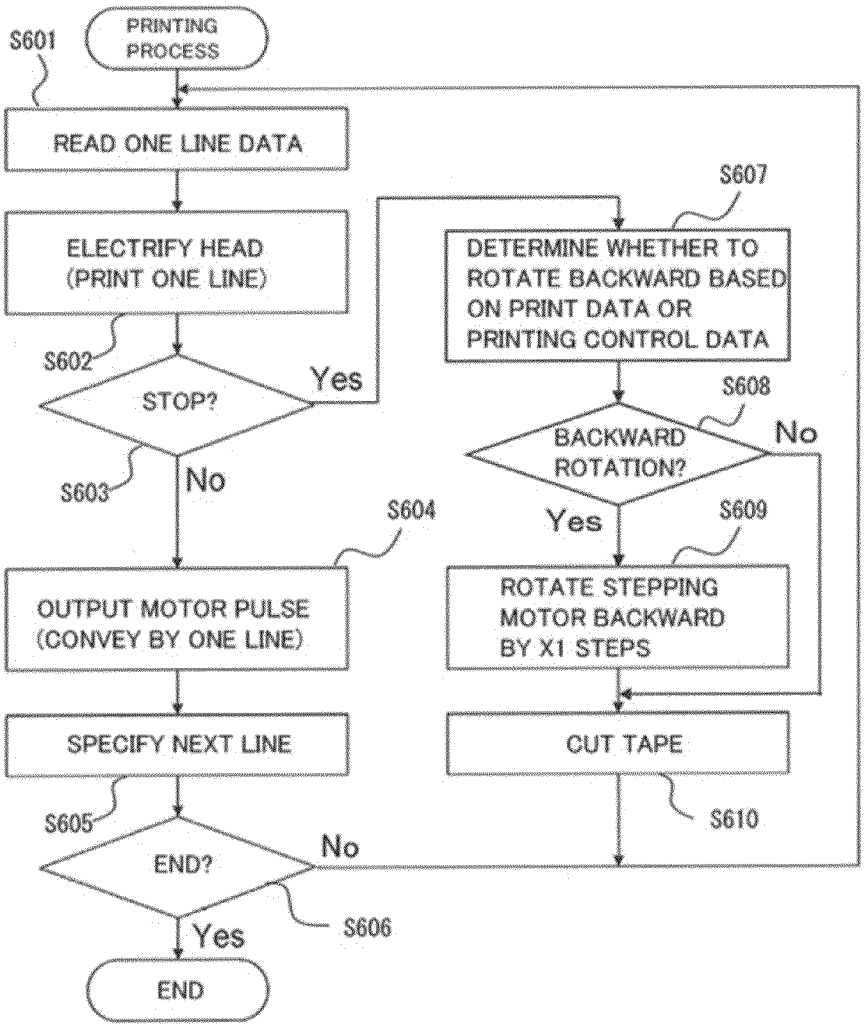
FIG. 6 is a flowchart exemplifying Embodiment 1 of the printing process.

FIG. 6 is a flowchart exemplifying Embodiment 1 of the printing process executed by the controller 30 in FIG. 4. This process is an operation of the controller 30 executing a printing program stored in the ROM 32. In the following explanation, FIGS. 1 to 4 are made reference to as appropriate.

First, the user operates the keyboard inputter 3 to enter data to print and set the format including the character size and margins, and operates a print key. As a result, the pattern data corresponding to the character data entered from the keyboard inputter 3 are read from the ROM 32 and loaded in a print data region of the RAM 33. Here, in this specification, the character data include data of genuine characters. However, the character data are not limited thereto and may include various kinds of data printable on a medium using the printing device of the present disclosure, such as numbers and symbols other than the characters and various kinds of designs. Here, when the data volume of print data to load is large, all data specified to print may not be loaded on the RAM 33 at a time. In such a case, the controller 30 loads and prints the print data in multiple portions while pausing the printing as appropriate.

Subsequently, the controller 30 rotates the stepping motor 38 forward via the motor drive circuit 39. As a result, the platen roller 23 moves to the print position where the platen roller 23 is pressed against the print head 22.

Then, the controller 30 starts executing the printing process exemplified with the flowchart of FIG. 6.

First, the controller 30 reads print data for one line from the print data region of the RAM 33 (Step S601). The one-line print data specify which heat-generating elements are electrified for printing among the given number of dot heat-generating elements of the print head 22.

Then, the controller 30 electrifies one or more heat-generating elements determined by the one-line print data among the given number of dot heat-generating elements of the print head 22 via the print head drive circuit 37 based on the one-line print data read in the Step S601, and prints the one line (Step S602).

Then, the controller 30 determines whether to stop the printing operation due to the above-described given task (Step S603).

If the controller 30 determines not to stop the printing operation (the determination in the Step S603 is No), the controller 30 outputs a forward rotation motor pulse signal to the stepping motor 38 via the motor drive circuit 39 to convey the printing tape 12 in the forward rotation direction (Step S604).

Then, the controller 30 specifies the next line (Step S605).

The controller 30 determines whether the print end position is reached as a result of specifying the next line in the Step S605 (Step S606).

If the print end position is not reached (the determination in the Step S606 is No), the controller 30 returns to the processing of the Step S601 and executes the printing process on the next line.

If the controller 30 determines to stop the printing operation (the determination in the Step S603 is Yes), the controller 30 first determines whether to rotate the stepping motor 38 backward based on the print data or printing control data (Step S607).

If the determination result in the Step S607 is no execution of the backward rotation (if the determination in the Step S608 is No), the controller 30 advances to the processing of Step S610 described later.

On the other hand, if the determination result in the Step S607 is execution of the backward rotation (if the determination in the Step S608 is Yes), the controller 30 rotates the stepping motor 38 backward via the motor drive circuit 39 by a fixed number of steps X1 based on the printing control data (Step S609).

Subsequently, the controller 30 drives the tape cut motor 40 via the cut motor drive circuit 41 based on the printing control data to operate the full-cut mechanism 27 or half-cut mechanism 28 (see FIG. 3) and cut the printing tape 12 in the full-cut or half-cut operation described above in the explanation of FIG. 3 (Step S610).

Then, the controller 30 returns to the processing of the Step S601 and executes the printing process for one line.

If the print end position is reached (the determination in the Step S606 is Yes), the controller 30 ends the flowchart of FIG. 6 to end the printing process.

In the printing process in Embodiment 1 described above, the stepping motor 38 is rotated backward based on the print data while the printing is stopped. In such a case, there is the risk of causing omitted printing if the backward rotation always by a fixed quantity is conducted while the printing is paused. More specifically, for example as shown in FIG. 5A, when the number of dots, a, in the partial character data on a line L1 immediately before the printing is stopped is high and the number of dots, b, in the partial character data on a line L2 that is the next line to the line L1 and the line immediately after the printing is resumed is low (the first condition hereafter for simplification), the backward rotation by the same quantity as in the case of the number of dots, a, being relatively low or the number of dots, b, being relatively high (the second condition hereafter for simplification) may rather cause omitted printing. Conversely, it was found that when the above second condition is satisfied, the backward rotation by a fixed quantity can suppress omitted printing. In other words, occurrence of omitted printing can be suppressed in both cases satisfying the first condition and second condition by not rotating the stepping motor backward when the print data before and after the printing is paused satisfy the above first condition, and rotating the stepping motor backward by a fixed quantity when the above first condition is not satisfied (in other words, when the above second condition is satisfied) . Here, because the heat-generating elements corresponding to the dots specified by the print data for the lines L1 and L2 among the multiple heat-generating elements of the head are electrified, the number of dots in the print data and the number of heat-generating elements to be electrified based on the print data are equal. As just described, the controller 30 operates as a backward rotation controller determining based on the state of the print data whether to rotate the stepping motor 38 in the opposite direction to before the operation of the stepping motor 38 is paused while the operation of the stepping motor 38 is paused. In the above-described case, the backward rotation of the stepping motor is controlled based on the print data before and after the printing is paused. However, the backward rotation of the stepping motor may be controlled based on the duration of pause of printing and/or the temperature of the print head 22 that is a thermal head. For example, as described above, when the head temperature change during the pause is sufficiently small, in other words when the printing is paused for a relatively short time and the head temperature is held within a certain range while the printing is paused, or when the head temperature is held within a certain range while the printing is paused through properly electrification while the printing is paused, the print head 22 and ink ribbon 14 (see FIGS. 2 and 3) are unlikely to adhere and the backward rotation by a fixed quantity can suppress omitted printing. In other words, the backward rotation by a fixed quantity is conducted when the controller determines that the head temperature is held within a certain range while the printing is paused based on the printing control data such as the duration of pause of printing at the time and the electrification control while the printing is paused and, conversely, the backward rotation is not conducted when the controller determines that the head temperature is not held within a certain range while the printing is paused based on the printing control data such as the duration of pause of printing and the electrification control. As just described, the controller 30 operates as a backward rotation controller determining based on the state of the printing control data whether to rotate the stepping motor 38 in the opposite direction to before the operation of the stepping motor 38 is paused while the operation of the stepping motor 38 is paused. As a result, it is possible to effectively suppress occurrence of omitted printing. Thus, in this embodiment, the controller 30 executes the above determination process based on the print data or printing control data in the Steps S607 and S608 and implements the backward rotation in the Step S609 depending on the determination result.

As described above, in Embodiment 1, it is determined whether to conduct the backward rotation depending on the situation of the print data or the printing control data at the time of the printing being stopped, and the above-described backward rotation by a fixed quantity X1 that is a predetermined constant is conducted when the backward rotation is necessary and the backward rotation is not conducted when unnecessary, whereby it is possible to suppress occurrence of omitted print regardless of the situation of the print data or the printing control data.

Figure 7:
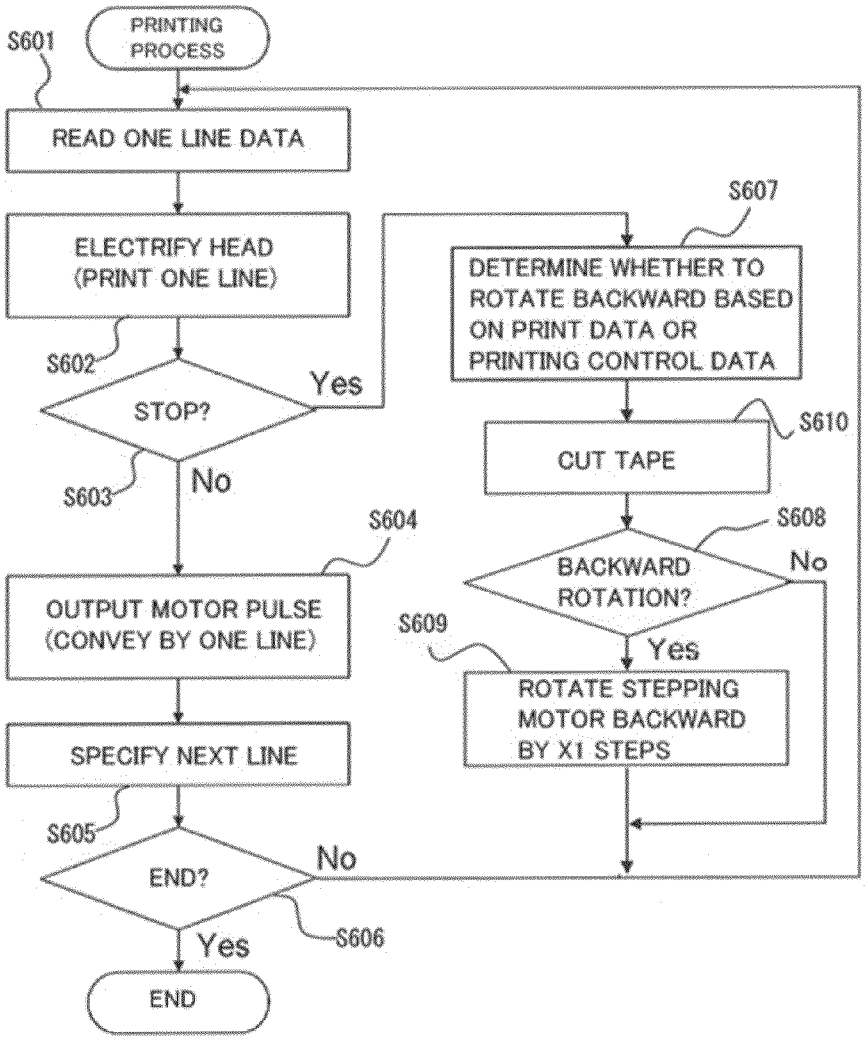
FIG. 7 is a flowchart exemplifying Embodiment 2 of the printing process.

FIG. 7 is a flowchart exemplifying Embodiment 2 of the printing process executed by the controller 30 in FIG. 4. This process is, as in the case of FIG. 6 according to Embodiment 1, an operation of the controller 30 executing a printing program stored in the ROM 32.

The flowchart of FIG. 7 is different from the flowchart of FIG. 6 in the following matters. In the flowchart of FIG. 6 according to Embodiment 1, at the time of the printing being stopped (if the determination in the Step S603 is Yes), the stepping motor 38 is rotated backward (Step S609) after the determination process in the Steps S607 and S608 and then the printing tape 12 is cut (Step S610). On the other hand, in the flowchart of FIG. 7 according to Embodiment 2, at the time of the printing being stopped (if the determination in the Step S603 is Yes), the printing tape 12 is cut (Step S610) after the determination process in the Step S607 and then the stepping motor 38 is rotated backward (Step S609) depending on the determination result in the Steps S607 and S608. The other processing in FIG. 7 is the same as in FIG. 6.

Also with the above printing process of Embodiment 2, it is possible to suppress occurrence of omitted print regardless of the situation of the print data or the printing control data in the same manner as in Embodiment 1 by determining whether to conduct the backward rotation depending on the situation of the print data or the printing control data at the time of the printing being stopped, and conducting the above-described backward rotation by a fixed quantity X1 that is a predetermined constant when the backward rotation is necessary, or not conducting the backward rotation when unnecessary.

Figure 8:
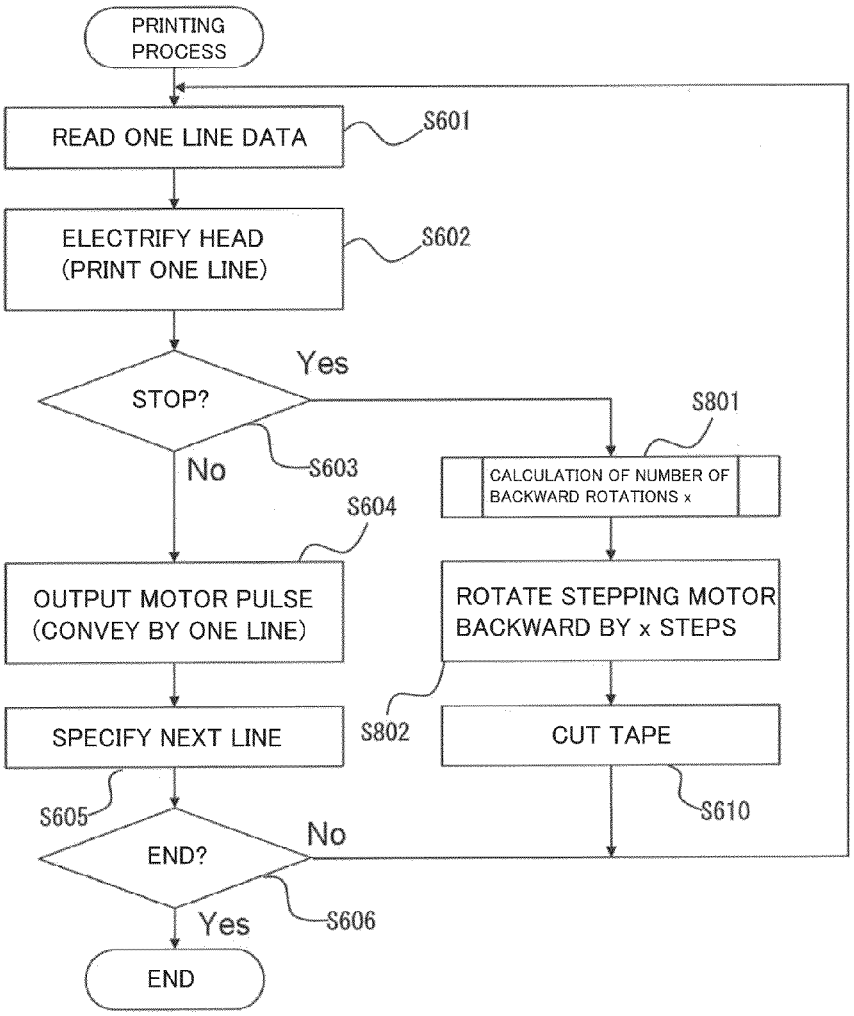
FIG. 8 is a flowchart exemplifying Embodiment 3 of the printing process.

FIG. 8 is a flowchart exemplifying Embodiment 3 of the printing process executed by the controller 30 in FIG. 4. This process is, as in the case of FIG. 6 according to Embodiment 1, an operation of the controller 30 executing a printing program stored in the ROM 32.

The flowchart of FIG. 8 is different from the flowchart of FIG. 6 in that the determination process in the Steps S607 and S608 and the backward rotation of the stepping motor 38 (Step S609) in the flowchart of FIG. 6 executed at the time of the printing being stopped (if the determination in the Step S603 is Yes) are executed as a process to specifically calculate the number of backward rotations, x, in which the number of backward rotations, x, is a variable (Step S801) and a process to rotate the stepping motor 38 backward by the number of backward rotations, x, (Step S802) in the flowchart of FIG. 8. The other processing in FIG. 8 is the same as in FIG. 6.

Figure 9:
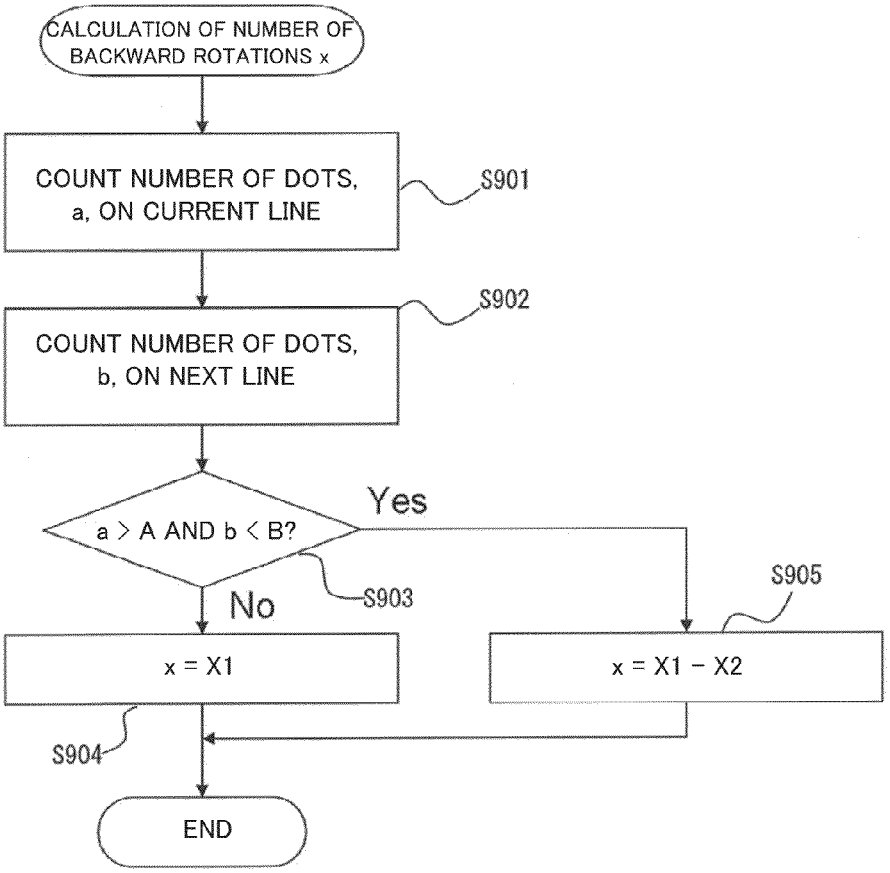
FIG. 9 is a flowchart showing a particular example of the process to calculate the number of backward rotations, x.

FIG. 9 is a flowchart showing a particular example of the process to calculate the number of backward rotations, x, in the Step S801 of FIG. 8.

In the flowchart of FIG. 9, the controller 30 first counts, on the one-line print data read in the Step S601 in FIG. 8, the number of dots, a, on the current line L1 (see FIG. 5A) corresponding to the position at the time of the printing being stopped (Step S901). Here, the one-line print data are data specifying which heat-generating elements are electrified for printing one line corresponding to the one-line print data among the multiple heat-generating elements of the print head 22, and the number of dots is the number of heat-generating elements specified to electrify for printing one line corresponding to the one-line print data in the print data.

Then, the controller 30 reads print data for the next line to the one-line print data read in the Step S601 in FIG. 8, and counts, on that one-line print data, the number of dots, b, on the next line L2 (see FIG. 5A) to the current line L1 at the position at the time of the printing being stopped (Step S902).

Then, the controller 30 determines whether the number of dots, a, calculated in the Step S901 is greater than a prescribed number A (a first number) and the number of dots, b, calculated in the Step S902 is lower than a prescribed number B (a second number) that is lower than the prescribed number A (Step S903). As stated in these Steps S901, S902, and S903, the controller 30 operates as a backward rotation controller determining based on the state of the print data whether to rotate the stepping motor 38 in the opposite direction to before the operation of the stepping motor 38 is paused by a first quantity while the operation of the stepping motor 38 is paused or by a second quantity smaller than the first quantity while the operation of the stepping motor 38 is paused.

If the determination in the Step S903 is No, the controller 30 sets the number of steps, x, to rotate the stepping motor 38 backward to a prescribed number of steps, X1 (Step S904).

If the determination in the Step S903 is Yes, the controller 30 sets the number of steps, x, to rotate the stepping motor 38 backward to the number "X1-X2" obtained by subtracting another prescribed number of steps, X2, from the subscribed number of steps, X1 (Step S905). Here, X1 and X2 are set to the following proper numbers. For example, when X2=X1 is set, the number of steps of backward rotation, x, set in the Step S905 is 0 (zero). In other words, in such a case, no backward rotation is conducted. Needless to say, X2 may be a proper nonzero number equal to or lower than X1. In such a case, the number of steps of backward rotation, x, is controlled depending on the pattern of the print data.

After the processing of the Step S904 or S905, the controller 30 ends the process to calculate the number of backward rotations, x, in the Step S801 of FIG. 8.

Returning to the explanation of the flowchart of FIG. 8, after the processing of the Step S801, the controller 30 controls the motor drive circuit 39 to rotate the stepping motor 38 backward by the number of steps of backward rotation, x, calculated in the Step S801 (Step S802).

Then, the controller 30 executes the same tape cutting process as in FIG. 6 (Step S610) and then returns to the processing of the Step S601.

In the above-described printing process in Embodiment 3, at the time of the printing being stopped, the stepping motor 38 is rotated backward by the prescribed value X1 when the difference between the number of print dots, a, on the line L1 at the time of the printing being stopped and the number of print dots, b, on the line L2 (the next line to the line L1) at the time of the printing being resumed is equal to or smaller than a prescribed value "A-B" in the Step S903 in FIG. 9, and the number of steps of backward rotation, x, is set to a value "X1-X2" that is lower than the prescribed value X1, for example 0 (no backward rotation is conducted) when the difference is larger than the prescribed value "A-B."

As described above, in Embodiment 3, it is possible to effectively suppress occurrence of omitted print regardless the situation of the print data by determining whether to conduct the backward rotation depending on the situation of the print data at the time of the printing being stopped, and conducting the backward rotation by a quantity x that is a variable specifically calculated when the backward rotation is necessary or not conducting the backward rotation when unnecessary.

Figure 10:
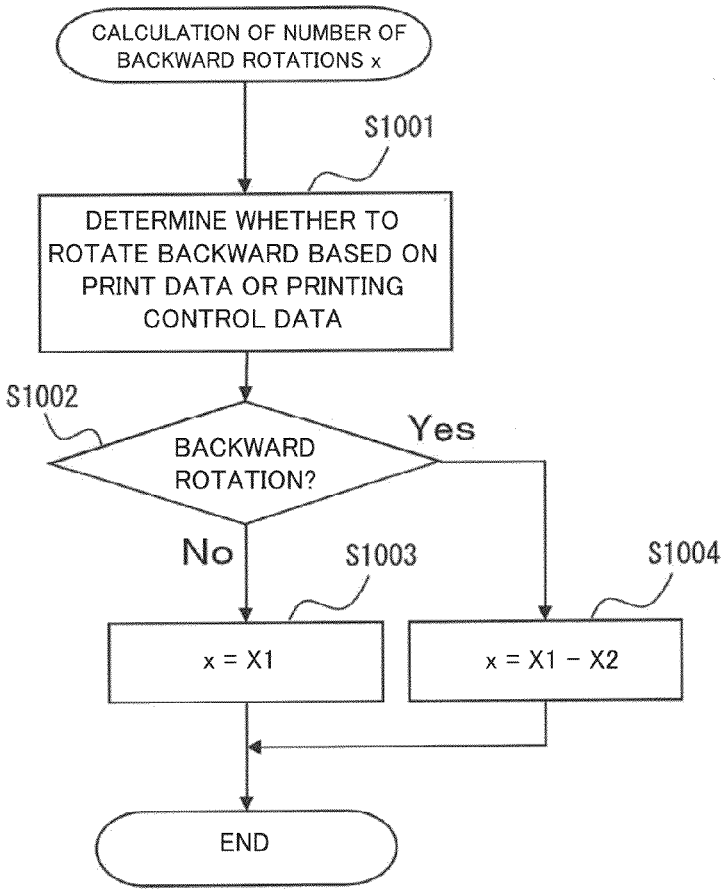
FIG. 10 is a flowchart showing a particular example of the process to change the backward rotation quantity x by judging the print data and printing control data in a comprehensive manner.

In the above Embodiment 3, the backward rotation quantity x is changed depending on the situation of the print data. This is not restrictive. The backward rotation quantity x may be changed depending on the situation of the printing control data as in the above-described Embodiments 1 and 2. FIG. 10 is a flowchart showing a particular example of the process to change the backward rotation quantity x by judging the print data and printing control data in a comprehensive manner.

First, the controller 30 determines whether to rotate the stepping motor 38 backward based on the print data or printing control data (Step S1001, S10002).

As a result, if the controller 30 determines that the head temperature is held within a certain range while the printing is paused based on the printing control data, for example, the duration of pause of printing and/or electrification control while the printing is paused in the Step S1001 and determines to conduct the backward rotation in the Step S1002, the backward rotation by a fixed quantity is conducted, in other words x=X1 (Step S1003).

Conversely, if the controller 30 determines that the head temperature is not held within a certain range while the printing is paused based on the printing control data, for example, the duration of pause of printing and/or electrification control in the Step S1001 and determines to conduct no backward rotation in the Step S1002, the number of steps of backward rotation, x, is set to a value "X1-X2" that is lower than the prescribed value X1, for example 0 (no backward rotation is conducted) (Step S1004).

In an modified embodiment of the above Embodiment 3, it is possible to effectively suppress occurrence of omitted print regardless of the situation of the printing control data by determining whether to conduct the backward rotation depending on the situation of the printing control data, and conducing the backward rotation by a quantity x that is a variable specifically calculated when the backward rotation is necessary, or not conducting the backward rotation when unnecessary. As just described, in the modified embodiment of Embodiment 3, the controller 30 operates as a backward rotation controller determining based on the state of the printing control data whether to rotate the stepping motor 38 in the opposite direction to before the operation of the stepping motor 38 is paused by a first quantity while the operation of the stepping motor 38 is paused or by a second quantity smaller than the first quantity while the operation of the stepping motor 38 is paused.

Figure 11:
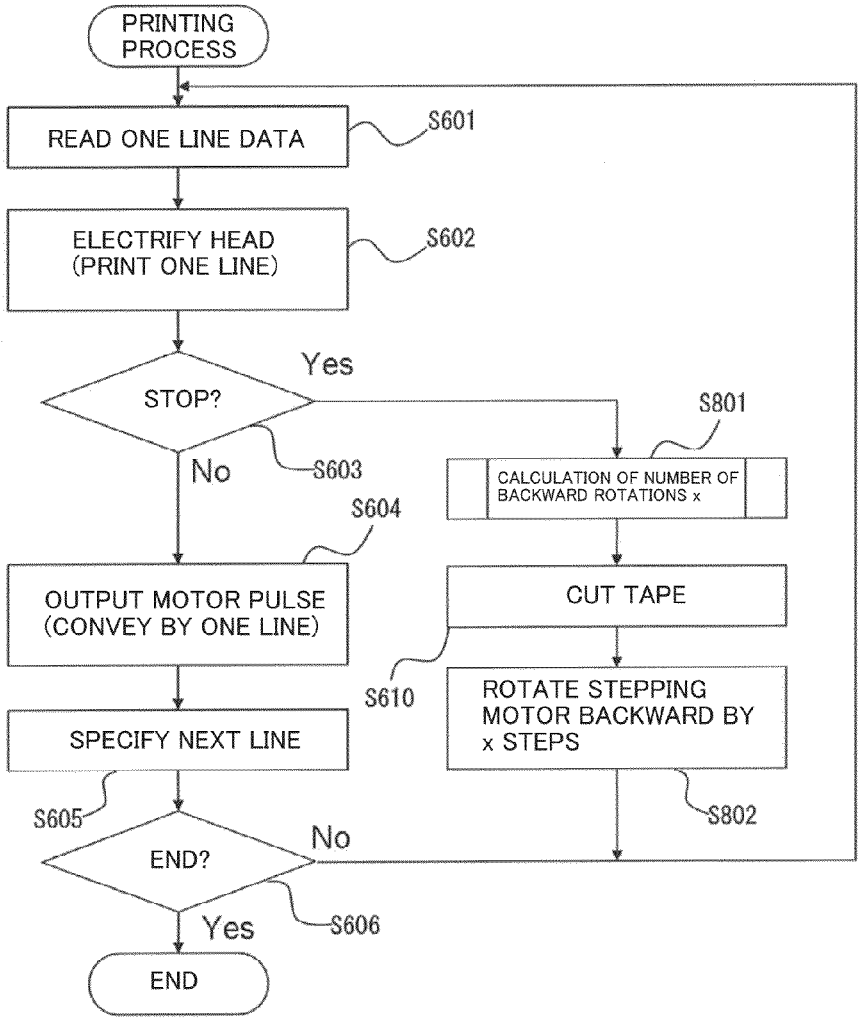
FIG. 11 is a flowchart exemplifying Embodiment 4 of the printing process.

FIG. 11 is a flowchart exemplifying Embodiment 4 of the printing process executed by the controller 30 in FIG. 4. This process is, as in the case of FIG. 8 according to Embodiment 3, an operation of the controller 30 executing a printing program stored in the ROM 32.

The flowchart of FIG. 11 is different from the flowchart of FIG. 8 in the following matters. In the flowchart of FIG. 8 according to Embodiment 3, at the time of the printing being stopped (if the determination in the Step S603 is Yes), the stepping motor 38 is rotated backward (Step S802) after the process to calculate the number of backward rotations, x, (Step S801) is executed, and then the printing tape 12 is cut (Step S610). On the other hand, in the flowchart of FIG. 11 according to Embodiment 4, at the time of the printing being stopped (if the determination in the Step S603 is Yes), following the Step S801, the printing tape 12 is cut (Step S610) and then the stepping motor 38 is rotated backward (Step S802). The other processing in FIG. 11 is the same as in FIG. 8.

Also with the above printing process of Embodiment 4, as in the same manner in Embodiment 3, it is possible using the modified embodiment of the process to calculate the number of backward rotations, x, exemplified in FIG. 10 in the Step S801 of FIG. 11 to effectively suppress occurrence of omitted print regardless of the situation of the print data by determining whether to conduct the backward rotation depending on the situation of the print data at the time of the printing being stopped, and conducting the backward rotation by a quantity x that is a variable specifically calculated when the backward rotation is necessary, or not conducting the backward rotation when unnecessary.

In the above Embodiment 4, the backward rotation quantity x is changed depending on the situation of the print data. This is not restrictive. As in the above-described Embodiment 1, Embodiment 2, and modified embodiment of Embodiment 3, the backward rotation quantity x may be changed depending on the situation of the printing control data. Also in a modified embodiment of the above Embodiment 4, it is possible to effectively suppress occurrence of omitted print regardless of the situation of the printing control data by determining whether to conduct the backward rotation depending on the situation of the printing control data, and conducting the backward rotation by a quantity x that is a variable specifically calculated when the backward rotation is necessary or not conducing the backward rotation when unnecessary.

In the above described embodiments, the printing tape 12 is various kinds of tape having an adhesive surface on the opposite side to the printable surface and a releasable tape applied to the adhesive surface. This is not restrictive. Even if the printing tape 12 is various kinds of tape having no releasable tape on the adhesive surface and the adhesive surface exposed, it is possible to effectively suppress occurrence of omitted print regardless of the pattern of the print data as in the embodiments.

EXAMPLES

Comparative experiments were conducted in accordance with the above-described embodiments to confirm the effects of the present disclosure. The details and results of the experiments are given below. Here, in all examples and comparative examples, printing was conducted based on printing control data causing a process of temporarily pausing the printing for full-cut operation of the tape to interrupt at least one time from the start to the end of printing labels.

Example 1

Using a test tape printer, print data satisfying the above-described first condition were printed on a tape of 46 mm in width. Printing control data causing a process of pausing the printing to interrupt only one time from the start to the end of printing the labels were used. Furthermore, the stepping motor was held in the stopped state while the printing was paused and then the printing was resumed.

Example 2

Using a test tape printer, print data satisfying the above-described second condition were printed on a tape of 46 mm in width. Printing control data causing a process of pausing the printing to interrupt only one time from the start to the end of printing the labels were used. Furthermore, the stepping motor was rotated in the opposite direction to before the pause while the printing was paused and then the printing was resumed.

Examples 3 and 4

Using a test tape printer, print data satisfying the above-described second condition were printed on a tape of 12 mm in width in Example 3 and on a tape of 9 mm in width in Example 4. Printing control data causing a process of pausing the printing to interrupt two times from the start to the end of printing the labels were used. Furthermore, the stepping motor was rotated in the opposite direction to before the pause while the printing was paused and then the printing was resumed.

Comparative Example 1

Using a test tape printer, print data satisfying the above-described first condition were printed on a tape of 46 mm in width. Printing control data causing a process of pausing the printing to interrupt only one time from the start to the end of printing the labels were used. Furthermore, the stepping motor was rotated in the opposite direction to before the pause while the printing was paused and then the printing was resumed.

Comparative Example 2

Using a test tape printer, print data satisfying the above-described second condition were printed on a tape of 46 mm in width. Printing control data causing a process of pausing the printing to interrupt only one time from the start to the end of printing the labels were used.

Furthermore, the stepping motor was held in the stopped state and then the printing was resumed.

Comparative Examples 3 and 4

Using a test tape printer, print data satisfying the above-described second condition were printed on a tape of 12 mm in width in Comparative Example 3 and on a tape of 9 mm in width in Comparative Example 4. Printing control data causing a process of pausing the printing to interrupt two times from the start to the end of printing the labels were used. Furthermore, the stepping motor was held in the stopped state while the printing was paused and then the printing was resumed.

(Experimental Results)

Figure 12A:
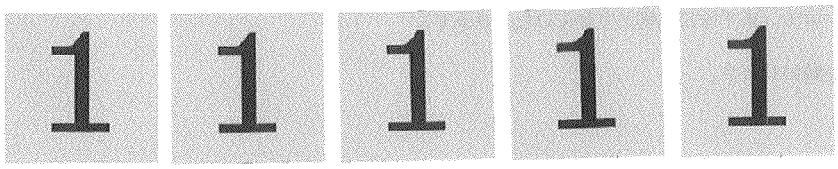
FIGS. 12A to 12D are illustrations showing the printing results of the examples.
Figure 12B:
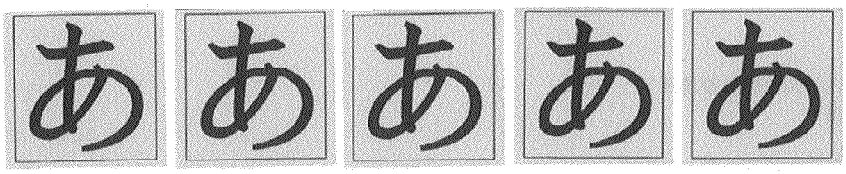
Figure 12C:
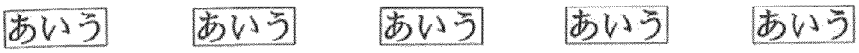
Figure 12D:
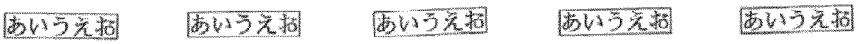
Figure 13A:
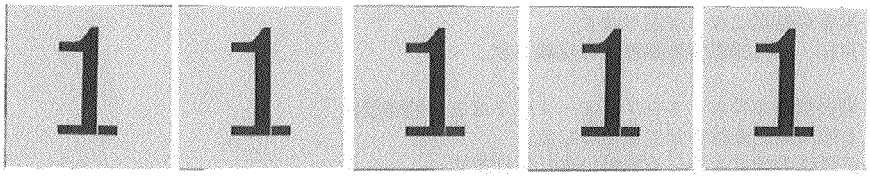
FIGS. 13A to 13D are illustrations showing the printing results of the comparative examples.
Figure 13B:
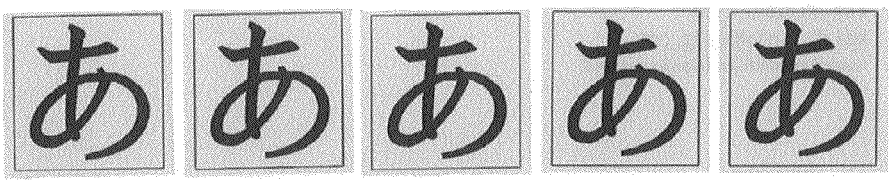
Figure 13C:
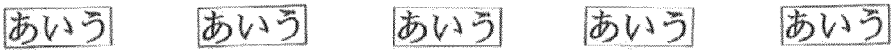

FIG. 12A shows the printing results in Example 1 (tape width: 46 mm); FIG. 12B, the printing results in Example 2 (tape width: 46 mm); FIG. 12C, the printing results in Example 3 (tape width: 12 mm); FIG. 12D, the printing results in Example 4 (tape width: 9 mm); FIG. 13A, the printing results in Comparative Example 1 (tape width: 46 mm); FIG. 13B, the printing results in Comparative Example 2 (tape width: 46 mm); FIG. 13C, the printing results in Comparative Example 3 (tape width: 12 mm); and FIG. 13D, the printing results in Comparative Example 4 (tape width: 9 mm).

First, in the case of printing print data satisfying the first condition on a tape of 46 mm in width, partially omitted print as shown in FIG. 12A was observed in Example 1. However, the partially omitted print occurred less frequently and in smaller sizes compared to Comparative Example 1 described next. On the other hand, it was found in the Comparative Example 1 in which the stepping motor was rotated in the opposite direction that as shown in FIG. 13A, omitted print occurs in larger sizes and at a high frequency compared to Example 1. Therefore, it can be said that in the case of printing print data satisfying the first condition on a tape of 46 mm in width, the state of omitted print is improved by holding the stepping motor in the stopped state rather than by rotating the stepping motor in the opposite direction.

In the case of printing print data satisfying the second condition on a tape of 46 mm in width, overall good printing results were obtained in both Example 2 and Comparative Example 2 as shown in FIGS. 12B and 13B, respectively.

Therefore, it can be said that in the case of printing print data satisfying the second condition on a tape of 46 mm in width, the printing results were overall good regardless of whether the stepping motor is rotated in the opposite direction while the printing is paused.

The above results of Examples 1 and 2 and Comparative Examples 1 and 2 are summarized as follows: holding the stepping motor in the stopped state improves the state of omitted print compared to rotating the stepping motor in the opposite direction while the printing is paused in the case of print data to print satisfying the first condition, and yields printing results overall as good as when the stepping motor is rotated in the opposite direction in the case of print data to print satisfying the second condition. Therefore, it can be said that at least in the case of print data to print satisfying the first condition, good printing results were obtained by holding the stepping motor in the stopped state while the printing was paused compared to when the stepping motor was rotated in the opposite direction.

Figure 13D:
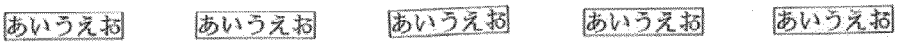

Then, in the case of printing print data satisfying the second condition on the tapes of 46 mm, 12 mm, and 9 mm in width, overall good printing results were obtained in Examples 2, 3, and 4 as shown in FIGS. 12B, 12C, and 12D, respectively. On the other hand, the printing results as shown in FIGS. 13B, 13C, and 13D were obtained in Comparative Examples 2, 3, and 4. In other words, the printing results were overall good in Comparative Example 2 while omitted print occurred in Comparative Examples 3 and 4. More specifically, omitted print occurred at "う" (in the half-cut operation) and "ゝ" on the second and subsequent pieces (in the full-cut operation) in the case of 12 mm in Comparative Example 3, and omitted print occurred between "え" and "お" and between "ゝ" and "う" on the second and subsequent pieces" in the case of 9 mm in the Comparative Example 4.

Therefore, it was found that in the case of print data to print satisfying the second condition, poor printing results can be prevented by, regardless of the tape width, holding the stepping motor in the stopped state while the printing is paused compared to rotating the stepping motor in the opposite direction. At least in printing on tapes of multiple different widths, it can be said that in the case of printing print data satisfying the second condition, the state of omitted print was improved by rotating the stepping motor in the opposite direction while the printing is paused rather than by holding the stepping motor in the stopped state.

From the above experimental results, it was found that at least in the case of print data to print satisfying the first condition, the state of omitted print is improved by holding the stepping motor in the stopped state while the printing is paused rather than by rotating the stepping motor in the opposite direction. Furthermore, it was found that in the case of print data to print satisfying the second condition, the state of omitted print is improved by rotating the stepping motor in the opposite direction while the printing is paused rather than by holding the stepping motor in the stopped state.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a print data creator creating print data to print on a medium;

a head printing on the medium on a line basis based on the print data;

a drive motor conveying the medium as the print data are printed on the medium;

a printing control data creator creating printing control data controlling the head and the drive motor, the printing control data including control data to pause printing on the medium by the head; and a backward rotation controller determining based on state of the print data or the printing control data whether to rotate the drive motor in the opposite direction to before the printing on the medium by the head is paused while the printing on the medium by the head is paused.

2. The printing device according to claim 1, wherein the head comprises a plurality of heat-generating elements arrayed in a line, and the backward rotation controller does not rotate the drive motor while the printing on the medium by the head is paused when number of the heat-generating elements to be electrified based on the print data for a first line in first printing conducted immediately before the printing on the medium by the head is paused is greater than a first prescribed number and number of the heat-generating elements to be electrified based on the print data for a second line that is the next line to the first line in second printing conducted after the printing is resumed is lower than a second prescribed number that is lower than the first prescribed number.

3. The printing device according to claim 2, wherein the backward rotation controller rotates the drive motor in the opposite direction while the printing on the medium by the head is paused when the number of the heat-generating elements to be electrified based on the print data for the first line is equal to or lower than the first prescribed number or the number of the heat-generating elements to be electrified based on the print data for the second line is equal to or greater than the second prescribed number.

4. The printing device according to claim 1, wherein the backward rotation controller rotates the drive motor in the opposite direction while the printing on the medium by the head is paused when duration of the pause of printing on the medium by the head is shorter than a prescribed time, and does not rotate the drive motor while the printing on the medium by the head is paused when the duration of the pause is equal to or longer than the prescribed time.

5. The printing device according to claim 1, wherein the backward rotation controller rotates the drive motor in the opposite direction while the printing on the medium by the head is paused when electrification is so controlled as to hold head temperature within a prescribed range, and does not rotate the drive motor while the printing on the medium by the head is paused when the electrification is not so controlled as to hold the head temperature within the prescribed range.

6. A printing device, comprising:

a print data creator creating print data to print on a medium;

a head printing on the medium on a line basis based on the print data;

a drive motor conveying the medium as the print data are printed on the medium;

a printing control data creator creating printing control data controlling the head and the drive motor, the printing control data including control data to pause printing on the medium by the head; and a backward rotation controller determining based on state of the print data or the printing control data whether to rotate the drive motor in the opposite direction to before the printing on the medium by the head is paused by a first quantity while the printing on the medium by the head is paused, or rotate the drive motor in the opposite direction to before the printing on the medium by the head is paused by a second quantity smaller than the first quantity while the printing on the medium by the head is paused.

7. The printing device according to claim 6, wherein the head comprises a plurality of heat-generating elements arrayed in a line, and the backward rotation controller rotates the drive motor in the opposite direction by the first quantity while the printing on the medium by the head is paused when number of the heat-generating elements to be electrified based on the print data for a first line in first printing conducted immediately before the printing on the medium by the head is paused is equal to or lower than a first prescribed number or number of the heat-generating elements to be electrified based on the print data for a second line that is the next line to the first line in second printing conducted after the operation of the drive motor is resumed is equal to or greater than a second prescribed number that is lower than the first prescribed number, and rotates the drive motor in the opposite direction by the second quantity while the printing on the medium by the head is paused when the number of the heat-generating elements to be electrified based on the print data for the first line is greater than the first prescribed number and the number of the heat-generating elements to be electrified based on the print data for the second line is lower than the second prescribed number.

8. The printing device according to claim 6, wherein the backward rotation controller rotates the drive motor in the opposite direction by the first quantity while the printing on the medium by the head is paused when duration of the pause of printing on the medium by the head is shorter than a prescribed time, and rotates the drive motor in the opposite direction by the second quantity while the printing on the medium by the head is paused when the duration of the pause is equal to or longer than the prescribed time.

9. The printing device according to claim 6, wherein the backward rotation controller rotates the drive motor in the opposite direction by the first quantity while the printing on the medium by the head is paused when the electrification is so controlled as to hold head temperature within a prescribed range, and rotates the drive motor in the opposite direction by the second quantity while the printing on the medium by the head is paused when the electrification is not so controlled as to hold the head temperature within the prescribed range.

10. A printing device control method for a printing device comprising a print data creator creating print data to print on a medium; a head printing on the medium on a line basis based on the print data; a drive motor conveying the medium as the print data are printed on the medium; and a printing control data creator creating printing control data controlling the head and the drive motor, the printing control data including control data to pause printing on the medium by the head, wherein it is determined based on state of the print data or the printing control data whether to rotate the drive motor in the opposite direction to before the printing on the medium by the head is paused while the printing on the medium by the head is paused.

11. The printing device control method according to claim 10, wherein the head comprises a plurality of heat-generating elements arrayed in a line, and whether to rotate the drive motor in the opposite direction is determined as follows:

the drive motor is not rotated while the printing on the medium by the head is paused when number of the heat-generating elements to be electrified based on the print data for a first line in first printing conducted immediately before the printing on the medium by the head is paused is greater than a first prescribed number and number of the heat-generating elements to be electrified based on the print data for a second line that is the next line to the first line in second printing conducted after the printing is resumed is lower than a second prescribed number that is lower than the first prescribed number.

12. The printing device control method according to claim 11, wherein whether to rotate the drive motor in the opposite direction is determined as follows:

the drive motor is rotated in the opposite direction while the printing on the medium by the head is paused when the number of the heat-generating elements to be electrified based on the print data for the first line is equal to or lower than the first prescribed number or the number of the heat-generating elements to be electrified based on the print data for the second line is equal to or greater than the second prescribed number.

13. The printing device control method according to claim 10, wherein whether to rotate the drive motor in the opposite direction is determined as follows:

the drive motor is rotated in the opposite direction while the printing on the medium by the head is paused when duration of the pause of printing on the medium by the head is shorter than a prescribed time, and is not rotated while the printing on the medium by the head is paused when the duration of the pause is equal to or longer than the prescribed time.

14. The printing device control method according to claim 10, wherein whether to rotate the drive motor in the opposite direction is determined as follows:

the drive motor is rotated in the opposite direction while the printing on the medium by the head is paused when electrification is so controlled as to hold head temperature within a prescribed range, and is not rotated while the printing on the medium by the head is paused when the electrification is not so controlled as to hold the head temperature within the prescribed range.

15. A non-transitory computer-readable nonvolatile recording medium having stored thereon an executable program, the program being a printing device control program for a computer to read and allow a controller of a printing device, the printing device comprising: a print data creator creating print data to print on a medium; a head printing on the medium on a line basis based on the print data; a drive motor conveying the medium as the print data are printed on the medium; and a printing control data creator creating printing control data controlling the head and the drive motor, the printing control data including control data to pause printing on the medium by the head, to determine based on state of the print data or the printing control data whether to rotate the drive motor in the opposite direction to before the printing on the medium by the head is paused while the printing on the medium by the head is paused.

16. The non-transitory computer-readable nonvolatile recording medium having stored thereon a printing device control program according to claim 15, wherein the head comprises a plurality of heat-generating elements arrayed in a line, and the computer reads the program and allows the controller of the printing device to determine whether to rotate the drive motor in the opposite direction as follows:

the drive motor is not rotated while the printing on the medium by the head is paused when number of the heat-generating elements to be electrified based on the print data for a first line in first printing conducted immediately before the printing on the medium by the head is paused is greater than a first prescribed number and number of the heat-generating elements to be electrified based on the print data for a second line that is the next line to the first line in second printing conducted after the printing is resumed is lower than a second prescribed number that is lower than the first prescribed number.

17. The non-transitory computer-readable nonvolatile recording medium having stored thereon a printing device control program according to claim 16, wherein the computer reads the program and allows the controller of the printing device to determine whether to rotate the drive motor in the opposite direction as follows:

the drive motor is rotated in the opposite direction while the printing on the medium by the head is paused when the number of the heat-generating elements to be electrified based on the print data for the first line is equal to or lower than the first prescribed number or the number of the heat-generating elements to be electrified based on the print data for the second line is equal to or greater than the second prescribed number.

18. The non-transitory computer-readable nonvolatile recording medium having stored thereon a printing device control program according to claim 15, wherein the computer reads the program and allows the controller of the printing device to determine whether to rotate the drive motor in the opposite direction as follows:

the drive motor is rotated in the opposite direction while the printing on the medium by the head is paused when duration of the pause of printing on the medium by the head is shorter than a prescribed time, and is not rotated while the printing on the medium by the head is paused when the duration of the pause is equal to or longer than the prescribed time.

19. The non-transitory computer-readable nonvolatile recording medium having stored thereon a printing device control program according to claim 15, wherein the computer reads the program and allows the controller of the printing device to determine whether to rotate the drive motor in the opposite direction as follows:

the drive motor is rotated in the opposite direction while the printing on the medium by the head is paused when electrification is so controlled as to hold head temperature within a prescribed range, and is not rotated while the printing on the medium by the head is paused when the electrification is not so controlled as to hold the head temperature within the prescribed range.

* * * * *